US011498786B2

(12) United States Patent
Adaniya et al.

(10) Patent No.: US 11,498,786 B2
(45) Date of Patent: Nov. 15, 2022

(54) SHEET FEEDING APPARATUS AND IMAGE FORMING APPARATUS

(71) Applicant: CANON KABUSHIKI KAISHA, Tokyo (JP)

(72) Inventors: Makoto Adaniya, Ryugasaki (JP); Hiroki Takano, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 16/737,060

(22) Filed: Jan. 8, 2020

(65) Prior Publication Data

US 2020/0231394 A1 Jul. 23, 2020

(30) Foreign Application Priority Data

Jan. 17, 2019 (JP) ..... JP2019-006143

(51) Int. Cl.

| | |
|---|---|
| ***B41J 29/54*** | (2006.01) |
| ***B65H 1/26*** | (2006.01) |
| ***G03G 15/20*** | (2006.01) |
| ***B65H 1/08*** | (2006.01) |
| ***B65H 3/46*** | (2006.01) |

(52) U.S. Cl.

CPC ..... *B65H 1/266* (2013.01); *B41J 29/54* (2013.01); *B65H 1/08* (2013.01); *B65H 3/46* (2013.01); *G03G 15/2003* (2013.01); *B65H 2801/03* (2013.01)

(58) Field of Classification Search

CPC . B65H 1/266; B65H 1/08; B65H 3/46; B65H 2801/03; B41J 29/54; G03G 15/2003; G03G 21/20

See application file for complete search history.

(56) References Cited

U.S. PATENT DOCUMENTS

| | | | | |
|---|---|---|---|---|
| 9,975,713 | B2 | 5/2018 | Yamaguchi | |
| 10,185,273 | B2 | 1/2019 | Adaniya | |
| 2015/0034623 | A1* | 2/2015 | Hata | G03G 15/6505 219/530 |
| 2017/0060077 | A1 | 3/2017 | Yamaguchi | |

FOREIGN PATENT DOCUMENTS

| | | | |
|---|---|---|---|
| JP | 2009-298523 | A | 12/2009 |
| JP | 2010-122334 | * | 6/2010 |
| JP | 2017-045007 | A | 3/2017 |

OTHER PUBLICATIONS

Machine translation of JP2010-122334 (Year: 2010).*

* cited by examiner

*Primary Examiner* — Thomas A Morrison
(74) *Attorney, Agent, or Firm* — Venable LLP

(57) ABSTRACT

Disclosed is a sheet feeding apparatus configured to be attached to an image forming apparatus. The sheet feeding apparatus includes a frame body and a locking member provided on an upper part of the frame body, the locking member being configured to be movable between a locking position where the frame body is locked to the image forming apparatus and a releasing position where the locking of the frame body is released, wherein in attaching the heating unit to an attaching position of the frame body, the locking member is configured to restrict a movement of the heating unit to the attaching position by interfering with the heating unit when the locking member is located at the releasing position and to allow a movement of the heating unit to the attaching position when the locking member is located at the locking position.

16 Claims, 15 Drawing Sheets

SHEET FEEDING APPARATUS AND IMAGE FORMING APPARATUS

BACKGROUND OF THE INVENTION

Field of the Invention

The present invention relates to a sheet feeding apparatus suitable for an image forming apparatus such as an electro-photographic copying machine or an electro-photographic printer (for example, a laser beam printer, an LED printer and the like).

Description of the Related Art

In the electro-photographic image forming apparatus, a toner image formed on a photosensitive body in an image forming portion is transferred to a sheet, and the toner image is heated and melted by a fixing device so that the toner image is fixed on the sheet. Japanese Patent Application Laid-Open No. 2017-45007 discloses the configuration that can be attached to and detached from a lower part of the main body of the image forming apparatus as a sheet feeding apparatus that feeds a sheet toward the image forming portion.

In addition, when the sheet on which the image is formed contains a lot of moisture, a toner image transfer failure may occur, or the sheet may curl so that the leading end of the sheet may be folded during sheet conveyance. To deal with this problem, Japanese Patent Application Laid-Open No. 2009-298523 discloses the configuration of a sheet feeding apparatus in which a heating unit that dehumidifies the sheet by heating can be attached above the sheet cassette in which sheets are stacked and stored.

When a heating unit is attached to and detached from the sheet feeding apparatus like the configuration of Japanese Patent Application Laid-Open No. 2009-298523 in the configuration in which the sheet feeding apparatus is attached to and detached from the lower portion of the main body of the image forming apparatus like the configuration of Japanese Patent Application Laid-Open No. 2009-298523, the following problem may occur.

Namely, when the heating unit is attached and detached in the state where the sheet feeding device is not fixed to the main body of the image forming apparatus, the relative position between the main body of the image forming apparatus and the sheet feeding apparatus may be displaced. In this case, a sheet feeding failure or the like may occur.

SUMMARY OF THE INVENTION

An object of the present invention is to provide a sheet feeding apparatus capable of suppressing the displacement of the relative position between the sheet feeding apparatus and the main body of the image forming apparatus when a heating unit is attached to or detached from the sheet feeding apparatus.

A representative configuration of the present invention is a sheet feeding apparatus configured to be attached to a lower part of an image forming apparatus with respect to a vertical direction and to feed a sheet to the image forming apparatus, the sheet feeding apparatus including a frame body; and a sheet cassette in which a sheet is stacked, the sheet cassette being accommodated in the frame body, wherein a heating unit configured to heat the sheet stacked in the sheet cassette is attachable to the frame body at a position above the sheet cassette with respect to the vertical direction, the sheet feeding apparatus comprising:

a locking member provided on an upper part of the frame body, the locking member being configured to be movable between a locking position where the frame body is locked to the image forming apparatus and a releasing position where locking of the frame body is released, wherein in attaching the heating unit to an attaching position of the frame body, the locking member is configured to restrict a movement of the heating unit to the attaching position by interfering with the heating unit when the locking member is located at the releasing position and to allow a movement of the heating unit to the attaching position when the locking member is located at the locking position.

Further features of the present invention will become apparent from the following description of exemplary embodiments with reference to the attached drawings.

DESCRIPTION OF THE EMBODIMENTS

<Image Forming Apparatus>

Hereinafter, the overall configuration of an image forming apparatus including a sheet feeding apparatus according to the present invention will be described with reference to the drawings together with operations during image formation. The size, material, shape, and relative arrangement of the components described below are not intended to limit the scope of the invention unless otherwise specifically noted.

Figure 1:
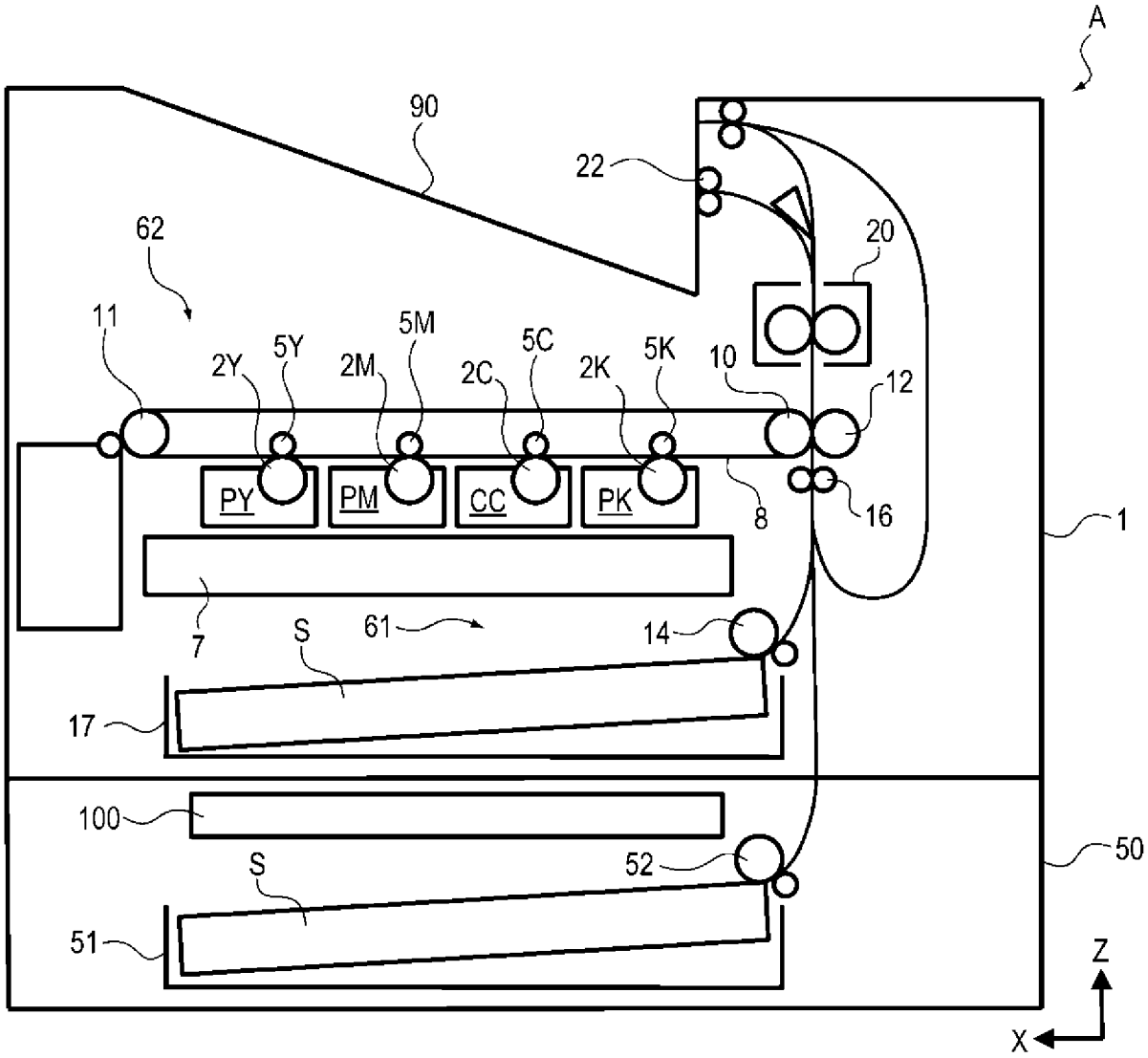
FIG. 1 is a schematic cross-sectional view of an image forming apparatus.

FIG. 1 is a cross-sectional schematic view of an image forming apparatus A. As shown in FIG. 1, the image forming apparatus A includes the image forming portion 62 that transfers a toner image to a sheet to form an image on the sheet, the sheet feeding unit 61 that feeds a sheet toward the image forming portion 62, and the fixing device 20 as a fixing portion for fixing the toner image onto a sheet.

The sheet feeding unit 61 includes the sheet cassette 17 in which the sheets S are stacked and stored and the feeding roller 14 that feeds the sheets S stacked and stored in the sheet cassette 17. The sheet cassette 17 is configured to be able to be inserted into and removed from the frame body 80 of the main body 1 of the image forming apparatus A. When a user stores the sheets in the sheet cassette 17, the sheet cassette 17 is pulled out by the user.

The image forming portion 62 includes the processes cartridges P (PY, PM, PC, and PK) in each of which the photosensitive drums 2 (2Y, 2M, 2C, and 2K), a charging roller (not shown), a developing device (not shown) are integrated. The image forming portion 62 further includes the primary transfer rollers 5 (5Y, 5M, 5C, and 5K), the laser scanner unit 7, the intermediate transfer belt 8, the secondary transfer roller 12, the secondary transfer counter roller 10, and the tension roller 11.

Under the main body 1 in the vertical direction of the image forming apparatus A, the sheet feeding apparatus 50 which is detachably attachable to the main body 1 is optionally provided. The sheet feeding apparatus 50 for feeding the sheets S toward the image forming apparatus 62 includes the sheet cassette 51 in which the sheets S are stacked and stored, and the sheet feeding roller 52 for feeding the sheets S stacked and stored in the sheet cassette 51. The sheet cassette 51 and the sheet feeding roller 52 are different from the ones provided in the sheet feeding portion 61. The sheet cassette 51 is configured to be able to be inserted into and removed from the frame body 300 (refer to FIG. 2) of the sheet feeding apparatus 50. When a user stores the sheets S, the sheet cassette 51 is pulled out by the user.

In the present embodiment, the image forming apparatus A refers to the entire apparatus including the main body 1 and the sheet feeding apparatus 50. Namely, the main body 1 refers to a portion other than the sheet feeding apparatus 50 in the image forming apparatus A.

As shown in FIG. 1, the sheet feeding apparatus 50 includes the detachably attachable heating unit 100. The heating unit 100 is disposed between the sheet cassette 51 and the sheet cassette 17. The heating unit 100 heats the sheets S stacked and stored in the sheet cassettes 51 and 17 so that the moisture contained in the sheet S is reduced, thereby suppressing a transfer failure of a toner image and curling of the sheets S.

As described above, the heating unit 100 dehumidifies the sheets S by heating the sheets S stacked and stored in the image forming apparatus A. Accordingly, even when the image forming apparatus A is placed in a hot and humid environment so that the sheets S accommodated in the device contain a lot of moisture, it is possible to suppress both the degradation of the quality of an image to be formed on the sheet S, and the abnormality of the conveyance due to curling.

Next, the operation of image forming will be described. First, when a control portion (not shown) receives an image forming job signal, the sheet S stacked on the sheet cassette 17 or the sheet cassette 51 is sent to the registration roller 16 by the feeding roller 14 or the feeding roller 52. The registration roller 16 conveys the sheet S at a predetermined timing to the secondary transfer portion configured by the secondary transfer roller 12 and the secondary transfer counter roller 10.

On the other hand, in the image forming portion, the surfaces of the photosensitive drums 2 are uniformly charged by charging rollers (not shown). Thereafter, the laser scanner unit 7 irradiates the surfaces of the photosensitive drums 2 of respective colors with laser light in accordance with image data transmitted from an external device (not shown) or the like, thereby forming electrostatic latent images on the surfaces of the photosensitive drums 2.

Thereafter, the toners of respective colors are attached to the electrostatic latent images formed on the surfaces of the photosensitive drums 2 by developing devices (not shown) to form toner images on the surfaces of the photosensitive drums 2. The toner images formed on the surfaces of the photosensitive drums are primarily transferred to the intermediate transfer belt 8, respectively, by applying bias to the primary transfer rollers 5. As a result, a full-color toner image is formed on the surface of the intermediate transfer belt 8.

Thereafter, the intermediate transfer belt 8 moves in a circular manner, so that the toner image is sent to the secondary transfer portion. By applying bias to the secondary transfer roller 12 at the secondary transfer portion, the toner image on the intermediate transfer belt 8 is transferred onto the sheet S.

Next, the sheet S to which the toner image has been transferred is heated and pressurized at the fixing device 20, whereby the toner image on the sheet S is fixed to the sheet S. Thereafter, the sheet S on which the toner image has been fixed is discharged to the discharge portion 90 by the discharge roller 22.

<Sheet Feeding Apparatus>

Next, the configuration of the sheet feeding apparatus 50 will be described.

Figure 2:
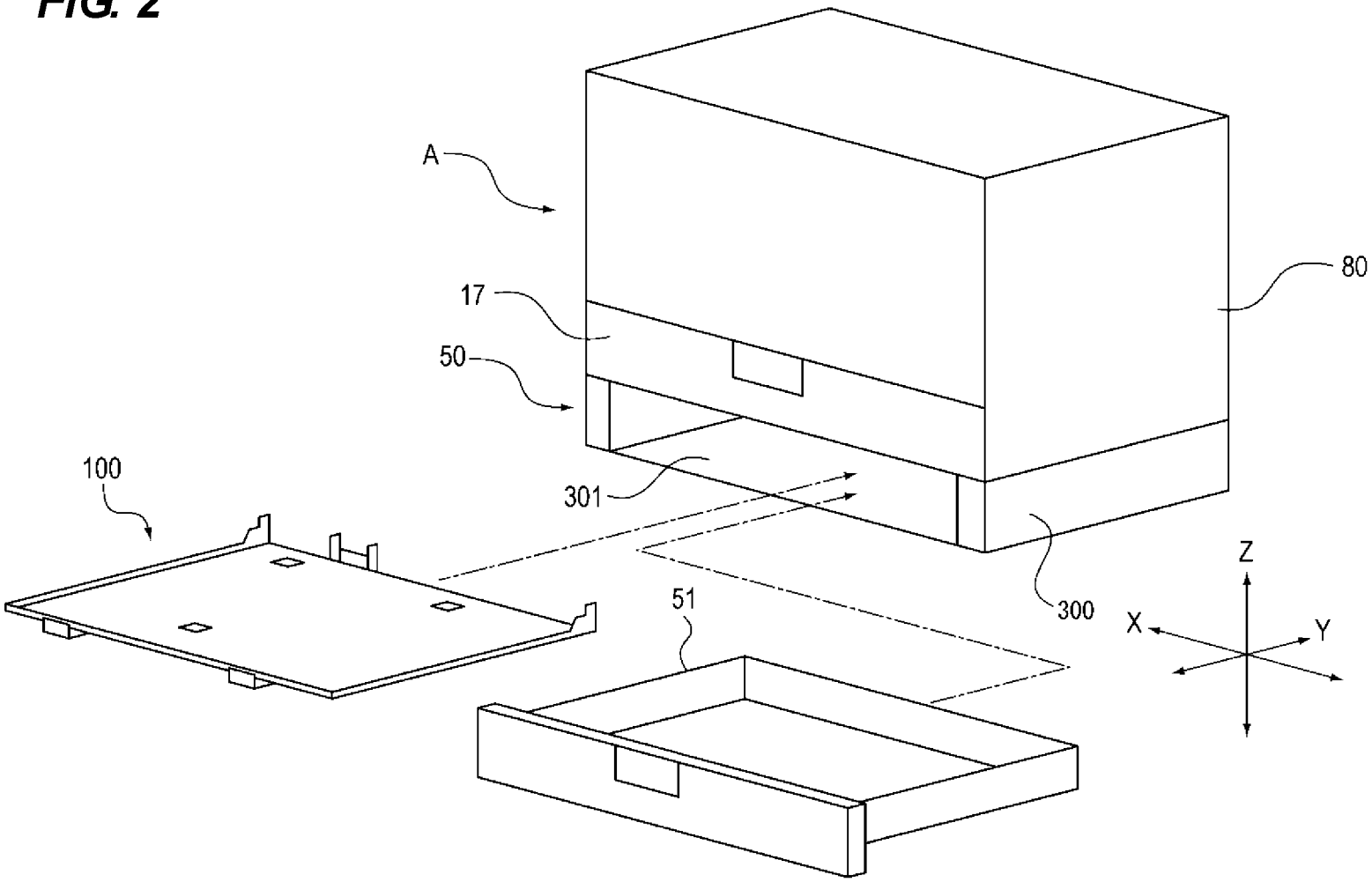
FIG. 2 is a schematic perspective view of a frame body of a main body of an image forming apparatus and a sheet feeding apparatus.

FIG. 2 is a schematic perspective view of the frame body 80 of the main body 1 of the image forming apparatus A and the sheet feeding apparatus 50. As shown in FIG. 2, the opening portion 301 is formed in the frame body 300 of the sheet feeding apparatus 50. The sheet cassette 51 and the heating unit 100 are attached to the frame body 300 by being inserted into the inside of the frame body 300 from the opening portion 301.

Figure 3:
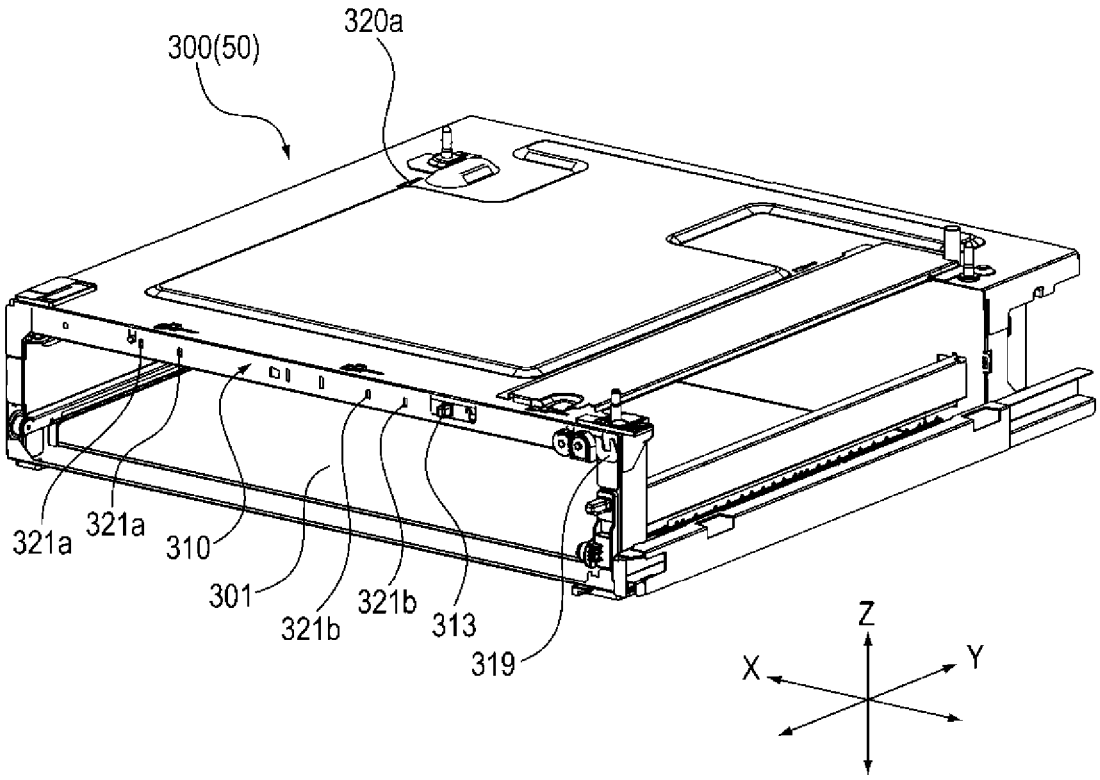
FIG. 3 is a perspective view of a frame body of the sheet feeding apparatus.
Figure 4:
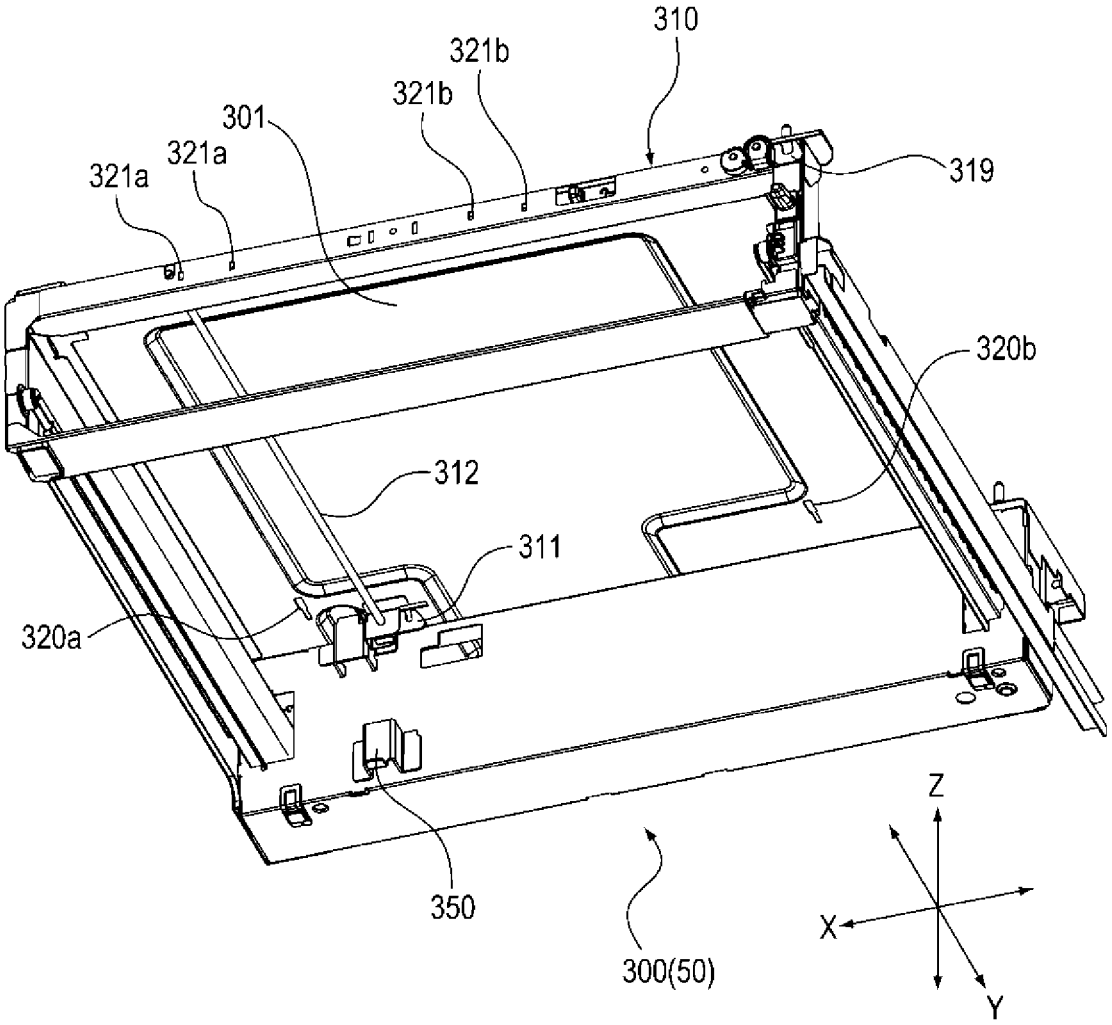
FIG. 4 is a perspective view of the frame body of the sheet feeding apparatus.

FIG. 3 is a perspective view of the frame body 300 of the sheet feeding apparatus 50 as viewed from above. FIG. 4 is a perspective view of the frame body 300 of the sheet feeding apparatus 50 as viewed from below. As shown in FIGS. 3 and 4, the frame body 300 has the front engagement hole portions 321*a*, the front engagement hole portions 321*b*, the rear engagement hole portion 320*a*, the rear engagement hole portion 320*b*, and the locking plate 350. The function of these members will be described later. The frame body 300 also has the locking mechanism 310 that restricts the movement of the frame body 300 relative to the frame body 80 of the main body 1.

The opening portion 301 formed in the frame body 300 is located below the locking mechanism 310 in the direction of the arrow Z. The sheet cassette 51 is inserted into and removed from the opening portion 301 in the directions of the arrow Y.

Figure 5:
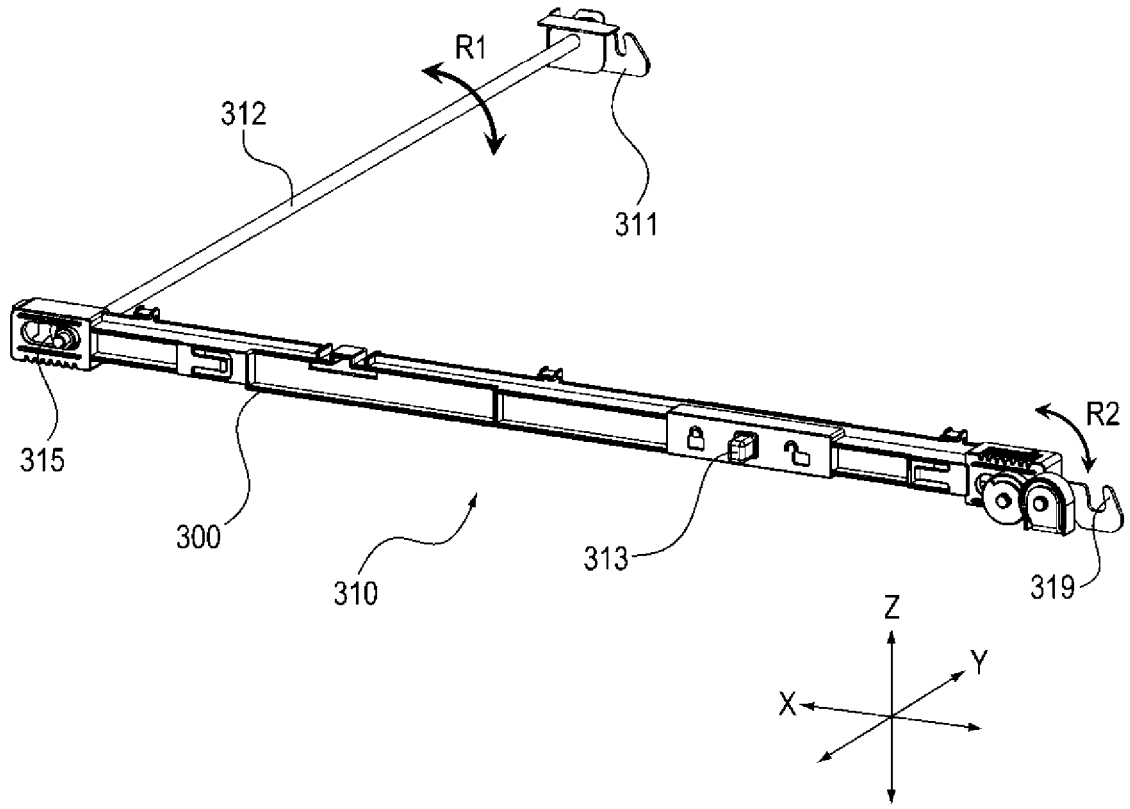
FIG. 5 is a perspective view of a locking mechanism.
Figure 6:
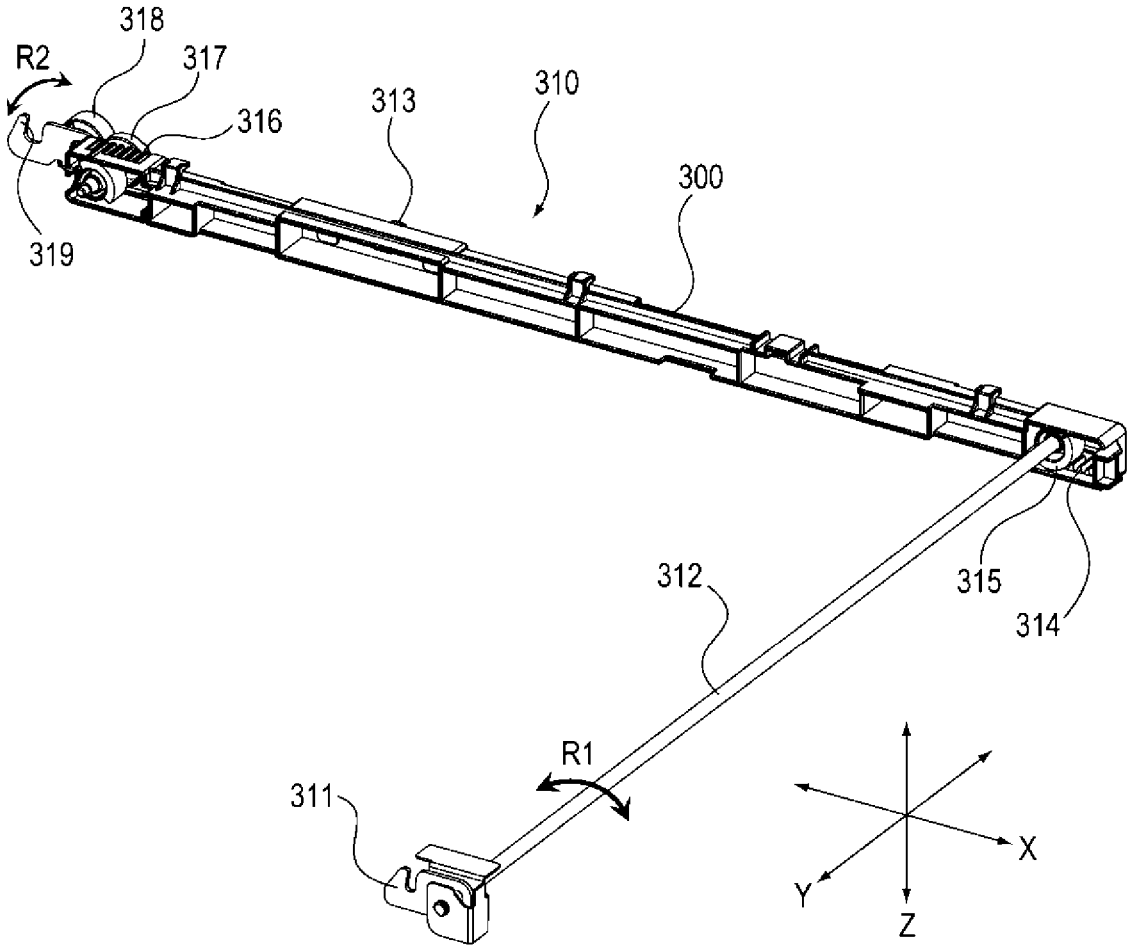
FIG. 6 is a perspective view of the locking mechanism.
Figure 7:
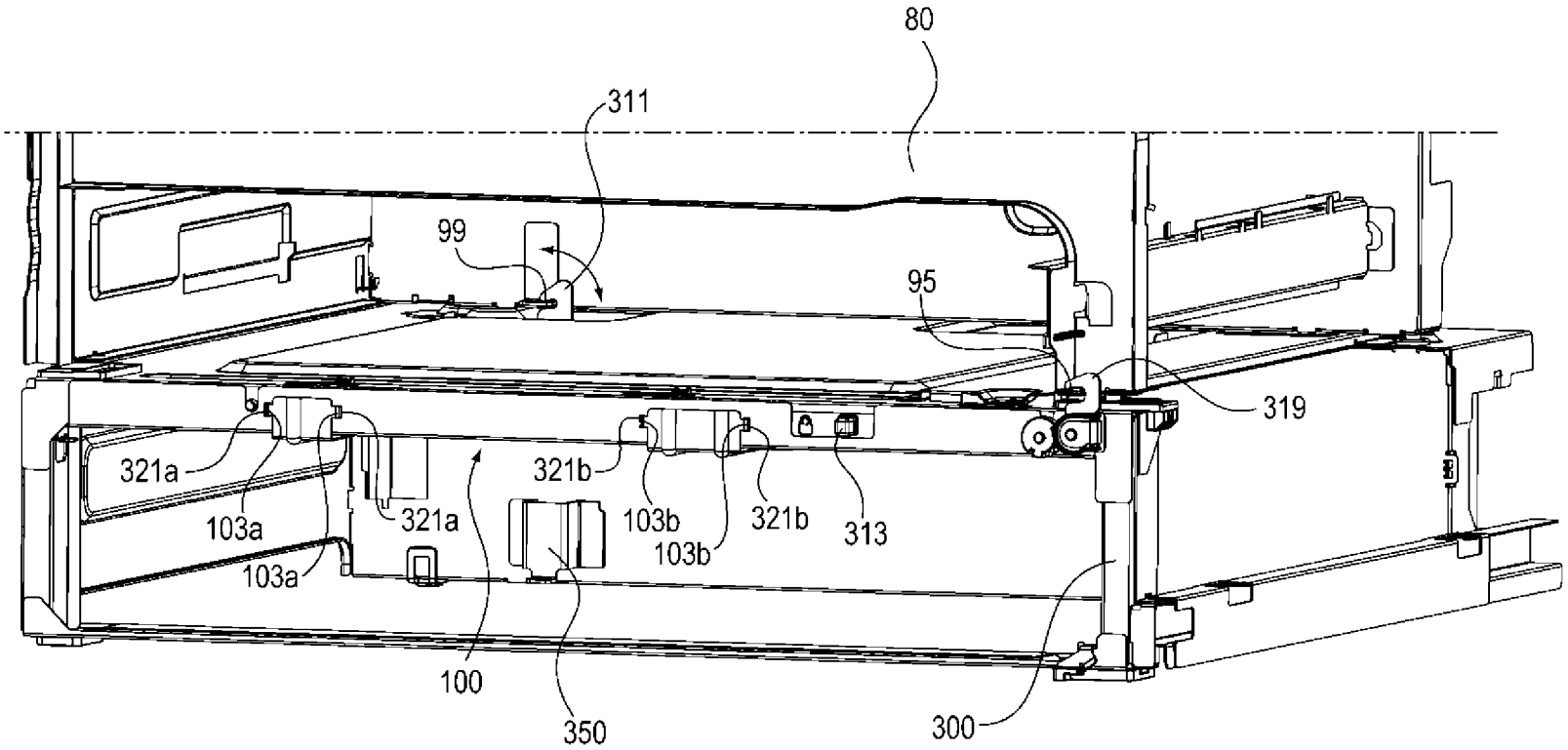
FIG. 7 is a perspective view of the frame body of the main body of the image forming apparatus and the frame body of the sheet feeding apparatus.
Figure 8A:
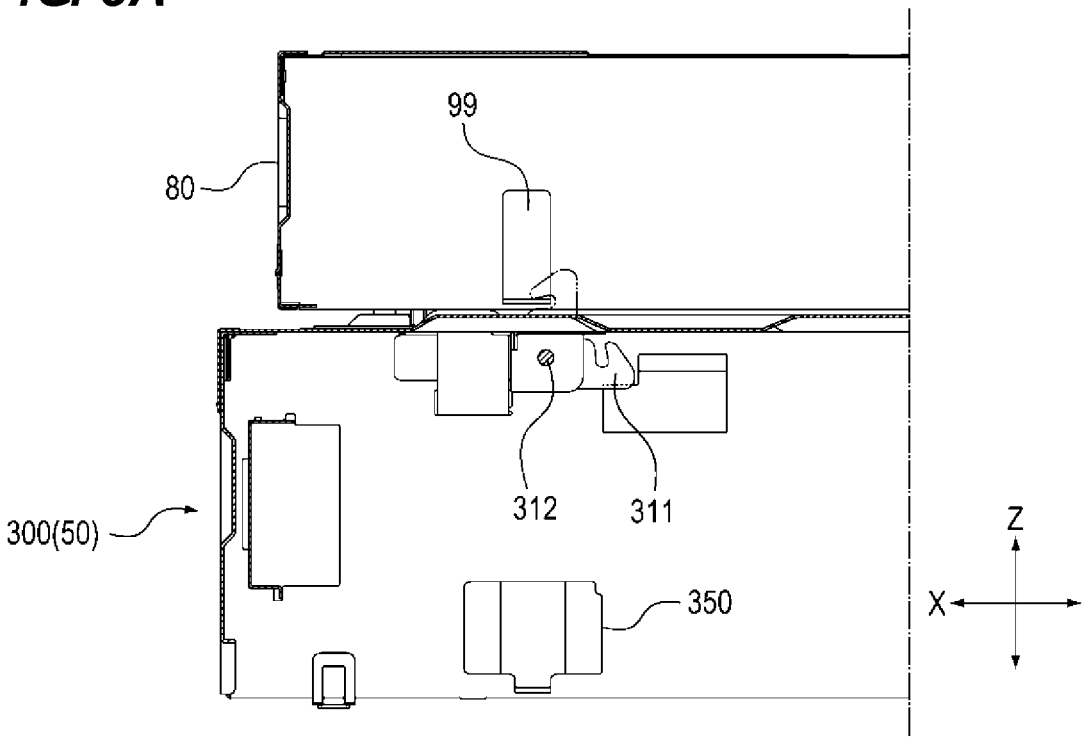
FIGS. 8A and 8B are cross-sectional views of the frame body of the main body of the image forming apparatus and the frame body of the sheet feeding apparatus.
Figure 8B:
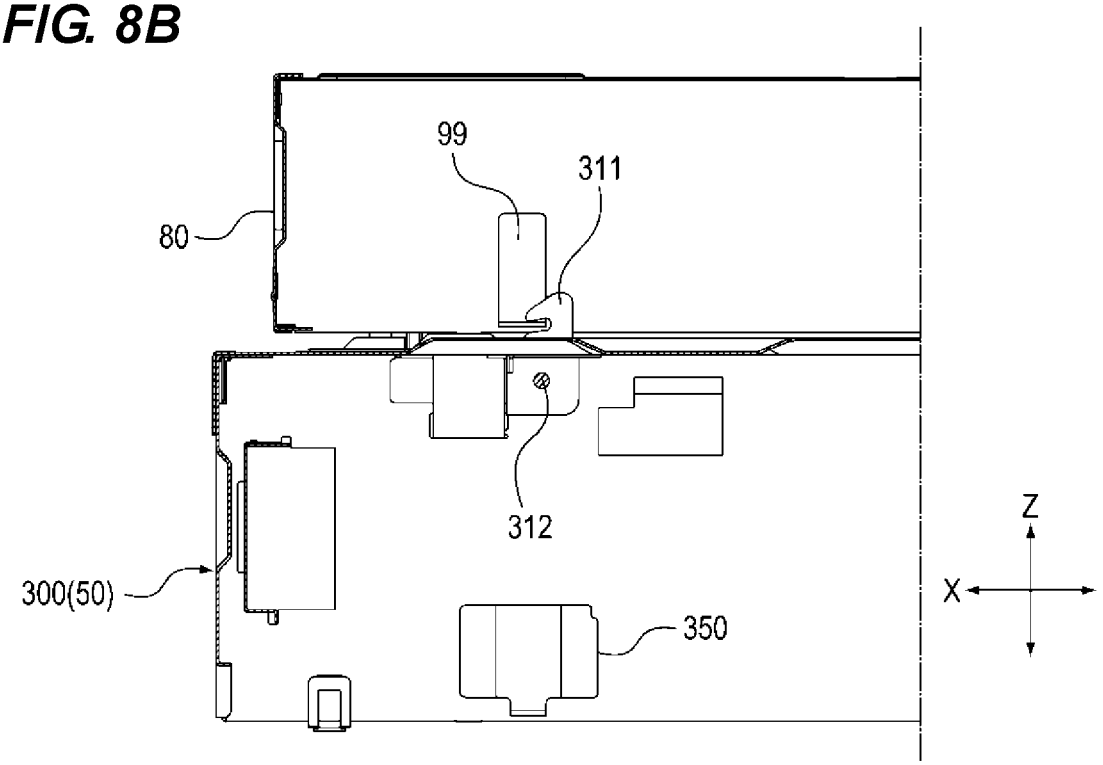

FIG. 5 is a perspective view of the locking mechanism 310 as viewed from the front side. FIG. 6 is a perspective view of the locking mechanism 310 as viewed from the rear side. FIG. 7 is a perspective view of the frame body 80 of the main body 1 of the image forming apparatus A and the frame body 300 of the sheet feeding apparatus 50 in the state where the heating unit 100 is attached. FIGS. 8A and 8B are cross-sectional views of the frame body 80 of the main body 1 of the image forming apparatus A and the frame body 300 of the sheet feeding apparatus 50. FIG. 8A shows the state in which the locking mechanism 310 is located at the releasing position, which will be described later. FIG. 8B shows the state in which the locking mechanism 310 is located at the locking position, which will be described later.

As shown in FIGS. 5 and 6, the locking mechanism 310 includes the operation portion 313 for a user to hold and operate, the front hook 319 (another locking member), and the rear hook 311 (a locking member). The front hook 319 is disposed upstream of the rear hook 311 in the direction of attaching the heating unit 100 to the frame body 300. Further, the front hook 319 and the rear hook 311 are connected to each other by a connecting member configured by a portion of the frame body 300, the operation portion 313, the shaft portion 312, and the like. The operation portion 313, the shaft portion 312 will be described later.

The locking mechanism 310 includes the operation portion 313, rack portions 314 and 316, the pinion gears 315 and 317 that respectively mesh with the rack portions 314 and 316, and the shaft portion 312. The shaft portion 312 (rotating shaft) pivotally supports the pinion gear 315 at one end, and pivotally supports the rear hook 311 at the other end.

When the operation portion 313 is held and moved in the direction of the arrow X (in a translational movement), the rack portion 314 moves in the direction of the arrow X. As a result, the pinion gear 315 that meshes with the rack portion 314 and the pinion gear 317 that meshes with the rack portion 316 rotate respectively.

As a result, the shaft portion 312 that pivotally supports the pinion gear 315 rotates, and the rear hook 311 that is pivotally supported by the shaft portion 312 rotates in the directions of the arrow R1. Further, the gear 318 which meshes with the pinion gear 315 rotates, and the front hook 319 which is coaxial with the gear 318 rotates in the directions of the arrow R2.

When the rear hook 311 rotates in the directions of the arrow R1 as described above, the rear hook 311 moves between the position where the rear hook 311 is engaged with the locking plate 99 provided on the frame body 80 of the main body 1 by being hooked on the locking plate 99 and the position where the engagement with the locking plate 99 is released as shown in FIGS. 7 and 8. When the rear hook 311 is engaged with the locking plate 99, the movement of the frame body 300 with respect to the frame body 80 is restricted, and when the engagement is released, the movement of the frame body 300 with respect to the frame body 80 is allowed.

Similarly, when the front hook 319 rotates in the directions of the arrow R2, the front hook 319 moves between the position where the front hook 319 is engaged with the locking plate 95 provided on the frame body 80 by being hooked on the locking plate 95 as shown in FIG. 8B and the position where the engagement with the locking plate 95 is released as shown in FIG. 8A. When the front hook 319 is engaged with the locking plate 95, the movement of the frame body 300 with respect to the frame body 80 of the main body 1 is restricted, and when the engagement is released, the movement of the frame body 300 with respect to the frame body 80 of the main body 1 is allowed.

That is, when the front hook 319 and the rear hook 311 rotate, they move together between the locking position where they are engaged with the locking plates 95 and 99 to lock the frame body 300 of the sheet feeding apparatus 50 with respect to the frame body 80 of the main body 1 and the releasing position where the engagement (locking) is released and the frame body 300 is allowed to move relative to the frame body 80 of the main body 1. The lock position is a restricting position where the movement of the frame body 300 relative to the frame body 80 of the main body 1 is restricted, and the releasing position is a position where the locking of the frame body 300 of the sheet feeding apparatus 50 with respect to the frame body 80 of the main body 1 is released.

In the present embodiment, in consideration of the balance of the locking mechanism 310, the front hook 319 and the rear hook 311 are arranged diagonally. However, the present invention is not limited to this, and the number and the arrangement of hooks can be changed as appropriate.

In the present embodiment, the configuration in which the front hook 319 and the rear hook 311 are rotated by the rack and pinion mechanism has been described. However, the present invention is not limited to this. For example, the rear hook 311 may be rotated by directly rotating the shaft portion 312, or a rotational driving force may be transmitted by a gear or a timing belt to rotate a plurality of hooks.

<Heating Unit>

Next, the configuration of the heating unit 100 will be described in detail.

Figure 9:
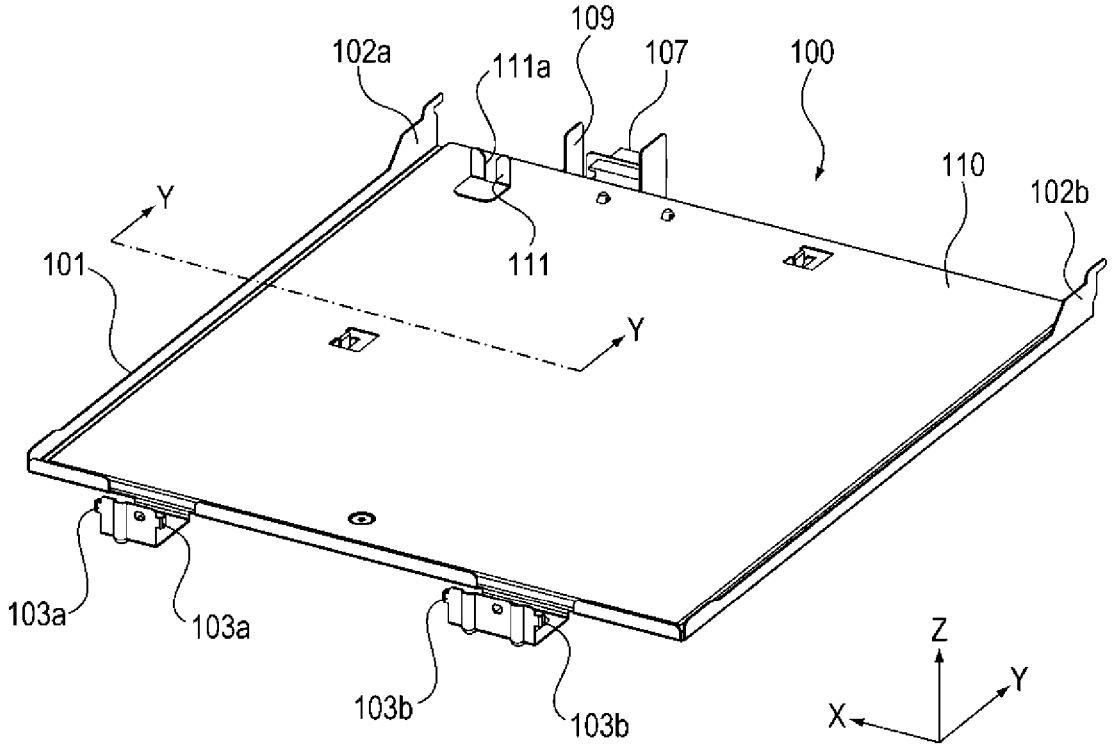
FIG. 9 is a perspective view of a heating unit.
Figure 10:
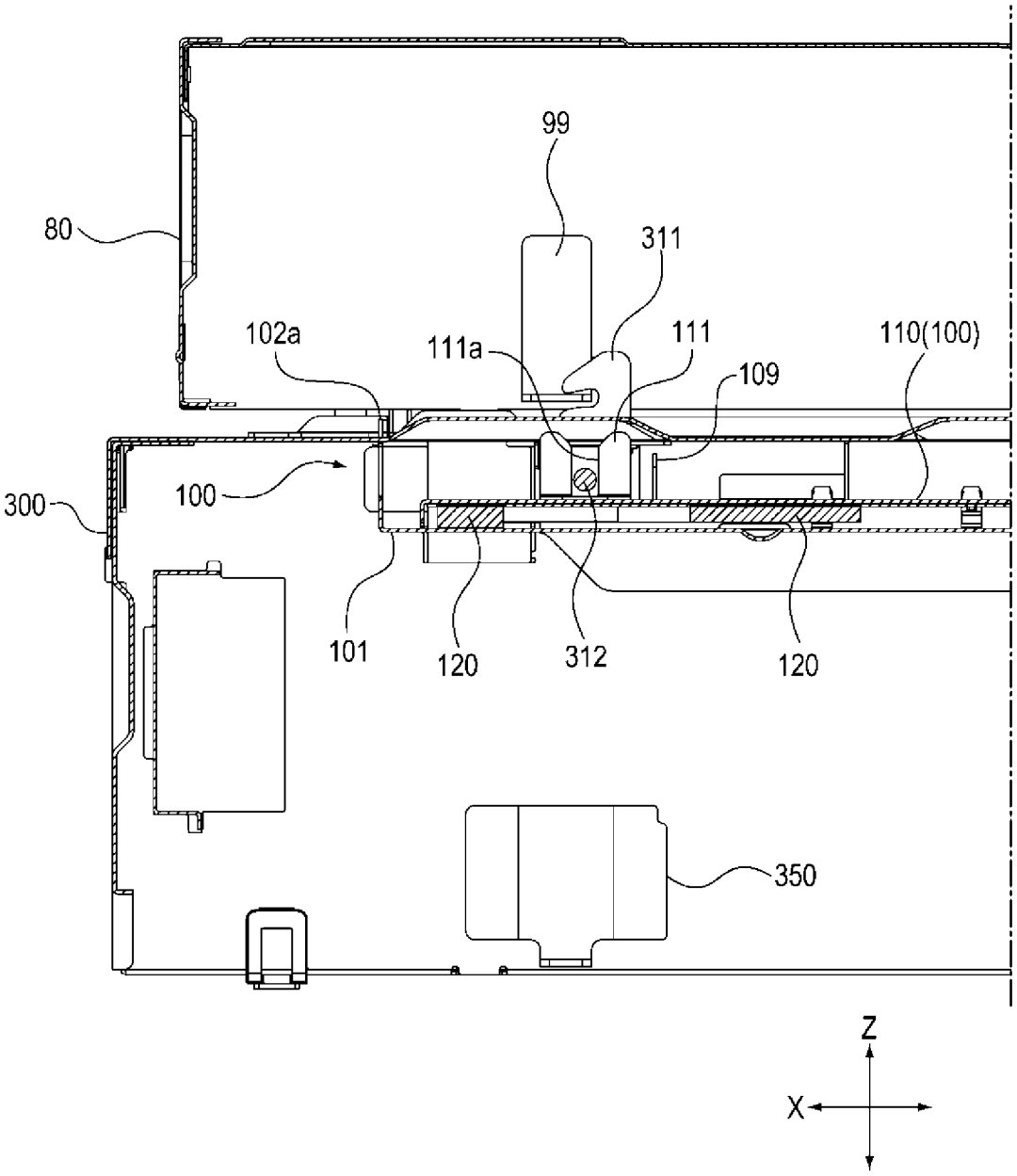
FIG. 10 is a cross-sectional view of the frame body of the main body of the image forming apparatus and the frame body of the sheet feeding apparatus in the state where the heating unit is attached.

FIG. 9 is a perspective view of the heating unit 100. FIG. 10 is a cross-sectional view of the frame body 80 of the main body 1 of the image forming apparatus A and the frame body 300 in the state where and the heating unit 100 is attached. The heating unit 100 shown in FIG. 10 corresponds to a view cut along the YY section shown in FIG. 9.

As shown in FIGS. 9 and 10, the heating unit 100 is attached at an upper part of the inside of the frame body 300. Specifically, the heating unit 100 is disposed above the sheet cassette 51 accommodated in the frame body 300 and is connected to the uppermost metal plate (top plate portion) constituting the frame body 300. The heating unit 100 includes the heater 120, the heater holding plate 101, and the heater cover 110.

The drawer connector 107 of the heater 120 is connected to a connector (not shown) of the main body 1, so that electric power is supplied to the heater 120 by the power supply on the main body 1 for generating heat. The heater 120 is held by the heater holding plate 101 and is covered with the heater cover 110 from above.

The heater holding plate 101 has the front engagement protruding portions 103*a*, the front engagement protruding portions 103*b*, the rear engagement protruding portion 102*a*, and the rear engagement protruding portion 102*b*. The front engagement protruding portions 103*a*, and the front engagement protruding portions 103*b* are fitted into the front engagement hole portions 321*a*, and the front engagement hole portions 321*b* of the frame body 300, respectively (see FIG. 7). The rear engagement protruding portions 102*a* and 102*b* are respectively fitted into the rear engagement hole portions 320*a* and 320*b* of the frame body 300 (see FIG. 7).

By this fitting, the heating unit 100 is positioned at the attaching position with respect to the frame body 300, and the drawer connector 107 and the connector (not shown) of the main body 1 can be connected. The connection between the drawer connector 107 and the connector (not shown) of the main body 1 may be performed by manual plugging and unplugging or by the configuration in which the drawer connector 107 is connected to the connector of the main body 1 automatically in accordance with the positioning of the heating unit 100. Further, regarding this positioning configuration, hole portions may be provided on the heater holding plate 101 and protruding portions may be provided on the frame body 300. The connector (not shown) of the main body 1 is an example of a first connector, and the drawer connector 107 is an example of a second connector. Instead of supplying the heater 120 with power by means of the power source on the main body 1, the heater 120 may be supplied with power from a commercial power source via an outlet dedicated to the heating unit 100 separately from the main body 1. In this case, by connecting the drawer connector 107 with a connector (not shown) for commercial power, power may be supplied. In this case, the connector (not shown) for commercial power is an example of the first connector, and the drawer connector 107 is an example of the second connector.

On the upper surface of the heater cover 110, the groove formed member 111 having the engaging groove 111*a* (engaging portion) is provided. The shaft portion 312 of the locking mechanism 310 is fitted into the engaging groove 111*a*. The heater cover 110 is provided with a protruding member 109 that protrudes upward above the upper surface of the heater cover 110. The protruding member 109 is disposed at a position adjacent to the groove formed member 111 when viewed from the direction of attaching the heating unit 100.

<Way of Attaching Heating Unit>

Next, a way of attaching the heating unit 100 to the frame body 300 will be described.

Figure 11A:
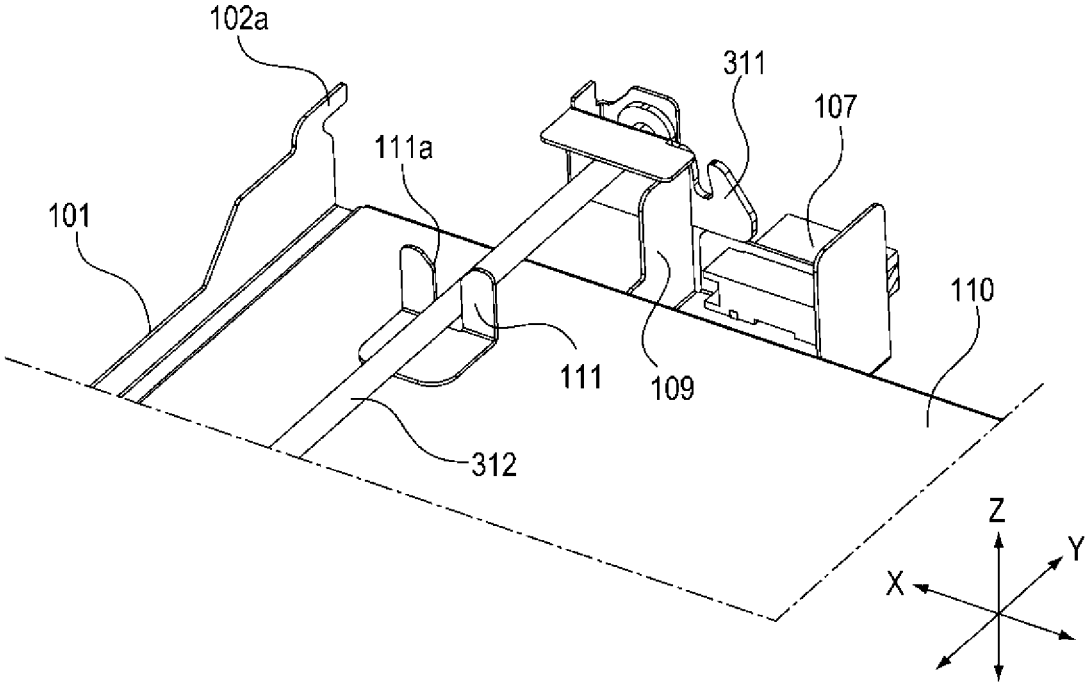
FIGS. 11A, 11B, and 11C are perspective views of the heating unit and the locking mechanism.
Figure 11B:
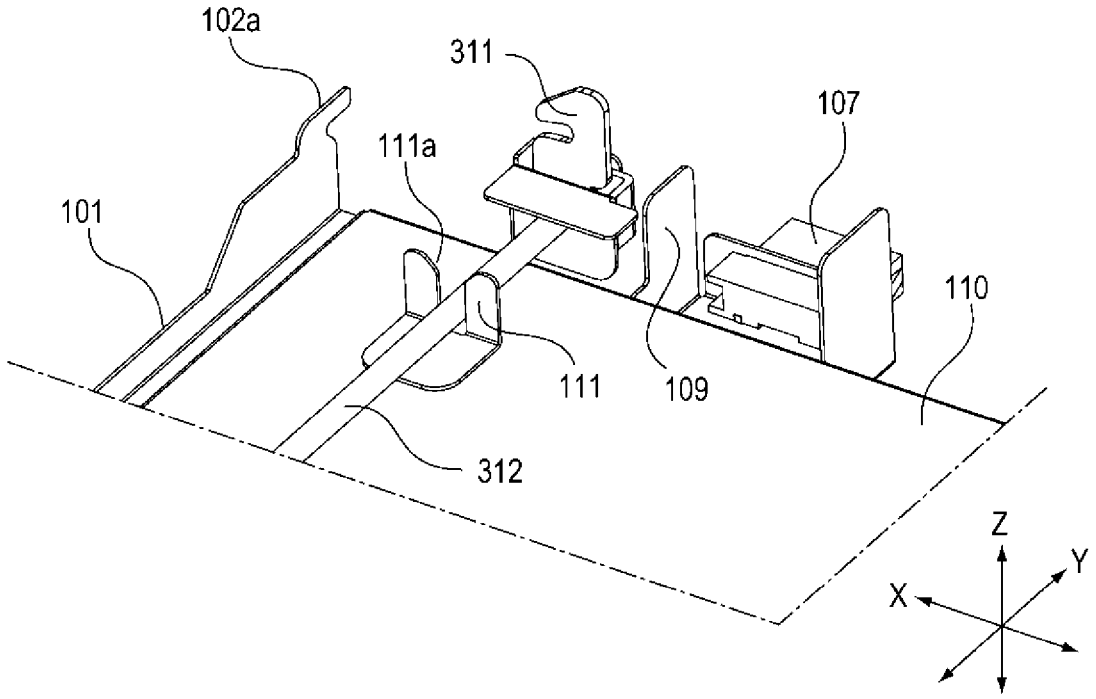
Figure 11C:
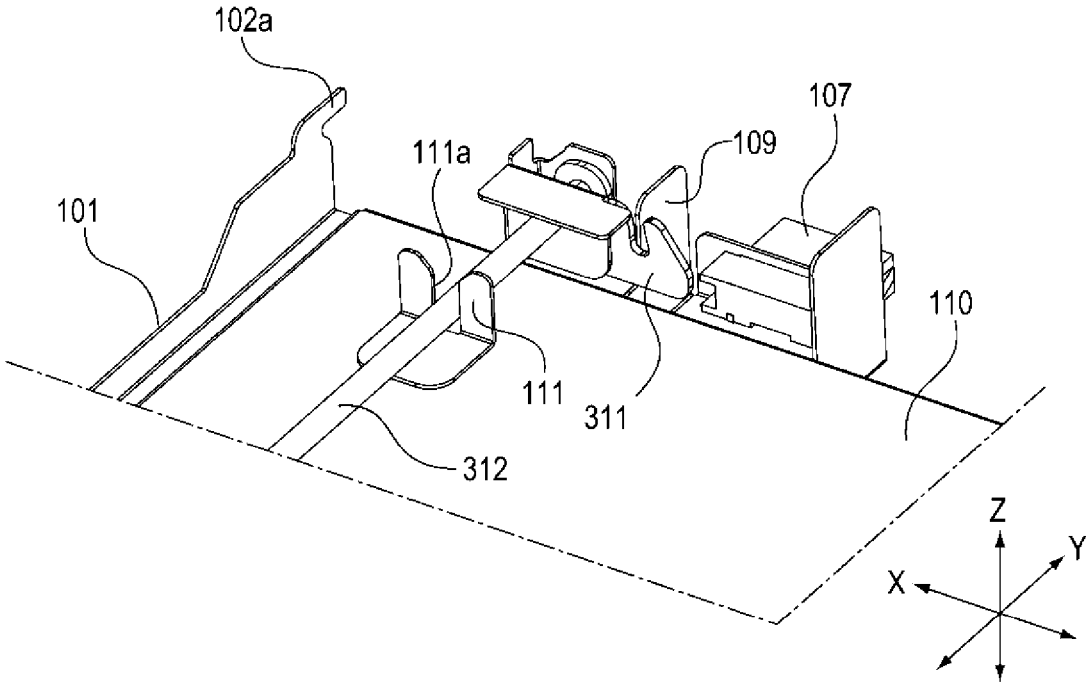

FIGS. 11A, 11B, and 11C are perspective views of the heating unit 100 and the locking mechanism 310. FIG. 11A shows the state where the rear hook 311 is located at the releasing position at which the rear hook 311 is not engaged with the locking plate 99. FIG. 11B shows the state where the rear hook 311 is located at the locking position at which the rear hook 311 is engaged with locking plate 99. FIG. 11C shows the state where the rear hook 311 is moved from the locking position to the releasing position after the heating unit 100 has been attached to the frame body 300.

As shown in FIGS. 11A, 11B, and 11C, in attaching the heating unit 100, the heating unit 100 is moved in the direction of the arrow Y while the shaft portion 312 is engaged with the engaging groove 111*a*. As a result, the movement of the heating unit 100 in the direction of attaching (the direction of the arrow Y) is allowed, while the movement in the direction (the direction of the arrow X) orthogonal to the direction of attaching and the vertical direction is restricted. Namely, the shaft portion 312 guides the movement of the heating unit 100 while engaging with the engaging groove 111*a* when the heating unit 100 is attached or detached.

As shown in FIG. 11A, when the rear hook 311 is located at the releasing position, the rear hook 311 is in the position where it abuts against the protruding member 109 of the heating unit 100 inside the opening portion 301. Accordingly, when an attempt is made to insert the heating unit 100 into the opening portion 301 for attaching, the protruding member 109 of the heating unit 100 and the rear hook 311 interfere with each other, so that the movement of the heating unit 100 toward the attaching position is restricted. As a result, the heating unit 100 cannot be attached. Therefore, the front engagement protruding portions 103*a*, the front engagement protruding portions 103*b*, and the rear engagement protruding portions 102*a* and 102*b* cannot be respectively engaged with the front engagement hole portions 321*a*, the front engagement hole portions 321*b*, and the rear engagement hole portions 320*a* and 320*b*.

On the other hand, as shown in FIG. 11B, when the rear hook 311 is located at the locking position, the rear hook 311 is in the position where the rear hook 311 does not abut against the protruding member 109 inside the opening portion 301. Therefore, the heating unit 100 is allowed to move to the attaching position without the interference between the protruding member 109 of the heating unit 100 and the rear hook 311, so that the heating unit 100 can move linearly to the attaching position inside the frame body 300 while being guided by the shaft portion 312. Namely, the heating unit 100 can move to the position where the front engagement protruding portions 103*a*, the front engagement protruding portions 103*b*, and the rear engagement protruding portions 102*a* and 102*b* can be respectively engaged with the front engagement hole portions 321*a*, the front engagement hole portions 321*b*, and the rear engagement hole portions 320*a* and 320*b*.

Further, as shown in FIG. 11C, when the heating unit 100 is attached to the frame body 300, the protruding member 109 of the heating unit 100 is located downstream of the rear hook 311 in the direction of attaching the heating unit 100. Therefore, even when the rear hook 311 is rotated in this state, the rear hook 311 and the protruding member 109 do not interfere with each other. As a result, the rear hook 311 can be moved between the locking position and the releasing position.

The front hook 319 is located outside the opening 301 of the frame body 300 in both the locking position and the releasing position. Therefore, when the heating unit 100 is attached or detached, the front hook 319 does not interfere with the heating unit 100.

As described above, when the heating unit 100 is attached and detached, the movement of the heating unit 100 is guided by the shaft portion 312 of the locking mechanism 310. Accordingly, the locking mechanism 310 performs both a function of fixing the frame body 300 of the sheet feeding apparatus 50 to the frame body 80 of the main body 1 of the image forming apparatus A and a function of guiding the movement of the heating unit 100. Therefore, the number of parts can be reduced and the heating unit 100 can be easily attached and detached as compared with the configuration in which a guide member is provided separately.

Further, when the rear hook 311 is located at the releasing position, the attaching of the heating unit 100 is restricted by the rear hook 311. Accordingly, it is possible to restrict the attaching of the heating unit 100 in the unstable state where the frame body 300 is not fixed to the frame body 80 of the main body 1 of the image forming apparatus A. Therefore, it is possible to suppress the relative position of the sheet feeding apparatus 50 to the main body 1 from being displaced as the heating unit 100 is attached.

Further, after the heating unit 100 is attached, the rear hook 311 can be rotated between the locking position and the releasing position. Accordingly, the sheet feeding apparatus 50 can be detached from the main body 1 of the image forming apparatus A by moving the rear hook 311 to the releasing position in the state where the heating unit 100 is attached to the frame body 300.

Although the locking position is obtained at the position shown in FIG. 11B, the locking position may be obtained when the rear hook 311 is located at a position within a predetermined range in the rotational direction of the rear hook 311. For example, a position where the rear hook 311 is further rotated from the position shown in FIG. 11B toward the releasing position where the engagement between the locking plate 99 and the rear hook 311 is released may be set as the locking position. In this case, in the rotational direction of the rear hook 311, positions from the position shown in FIG. 11B to the position where the engagement between the locking plate 99 and the rear hook 311 is released are defined as locking positions.

Although the releasing position is obtained at the position shown in FIG. 11A, the releasing position may be obtained when the rear hook 311 is located at a position within a predetermined range in the rotational direction of the rear hook 311. For example, a position where the rear hook 311 is further rotated from the position shown in FIG. 11A toward the locking position where the engagement between the locking plate 99 and the rear hook 311 is made may be set as the releasing position. In this case, in the rotational direction of the rear hook 311, positions from the position shown in FIG. 11A to the position where the engagement between the locking plate 99 and the rear hook 311 is made are defined as releasing positions.

As described above, as long as the configuration is adopted in which the heating unit 100 can be attached only in the state in which the relative position of the frame body 300 of the sheet feeding device 50 with respect to the frame 80 of the main body 1 is not displaced, the range of the locking positions and the releasing positions of the rear hook 311 may be changed as appropriate.

Figure 12:
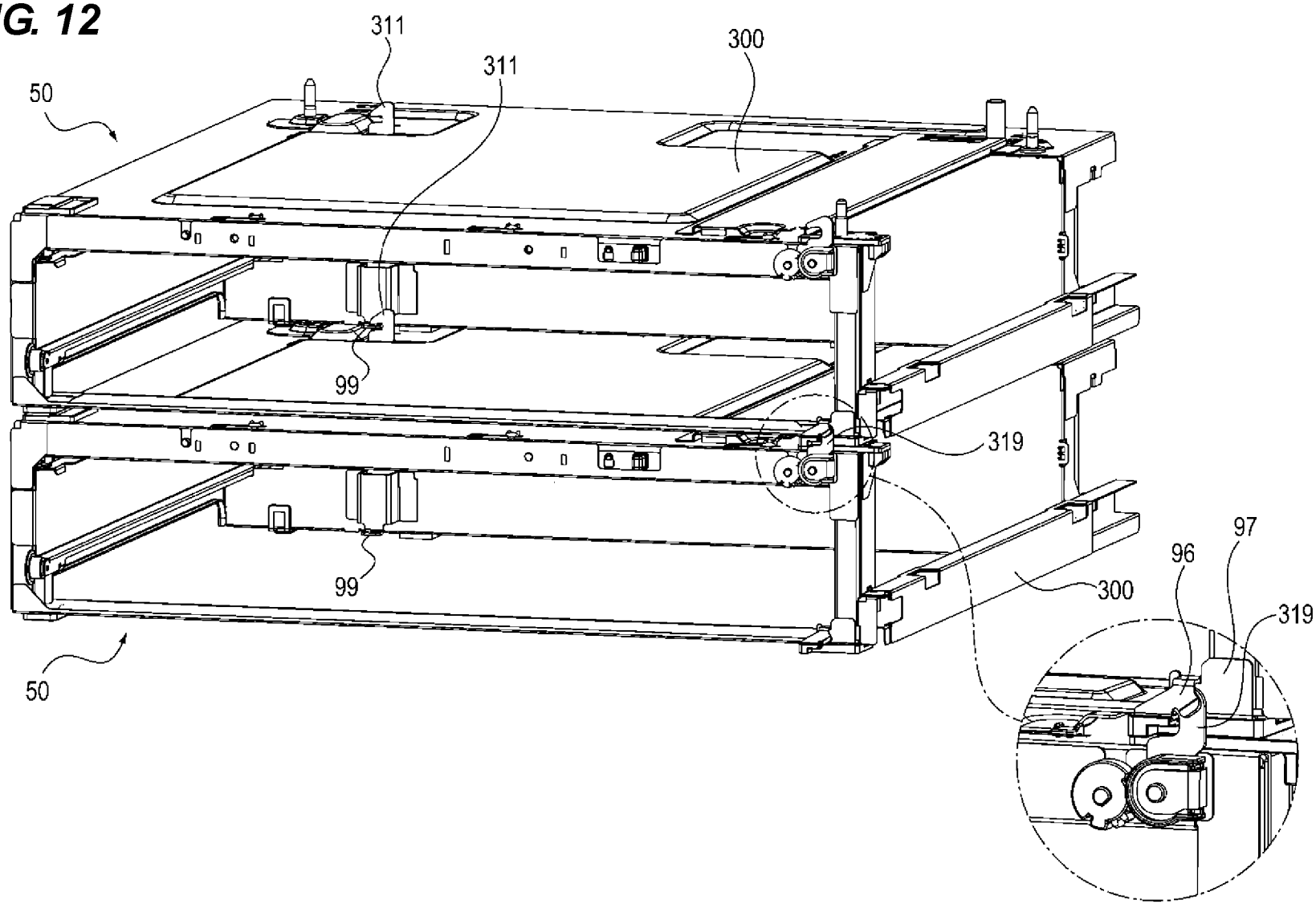
FIG. 12 is a perspective view when two sheet feeding apparatuses are connected.

It is also possible to provide a plurality of sheet feeding apparatuses 50 and connect them using the locking mechanism 310. FIG. 12 is a perspective view when two sheet feeding apparatuses 50 are connected, and FIG. 13 is a cross-sectional view thereof.

Figure 13:
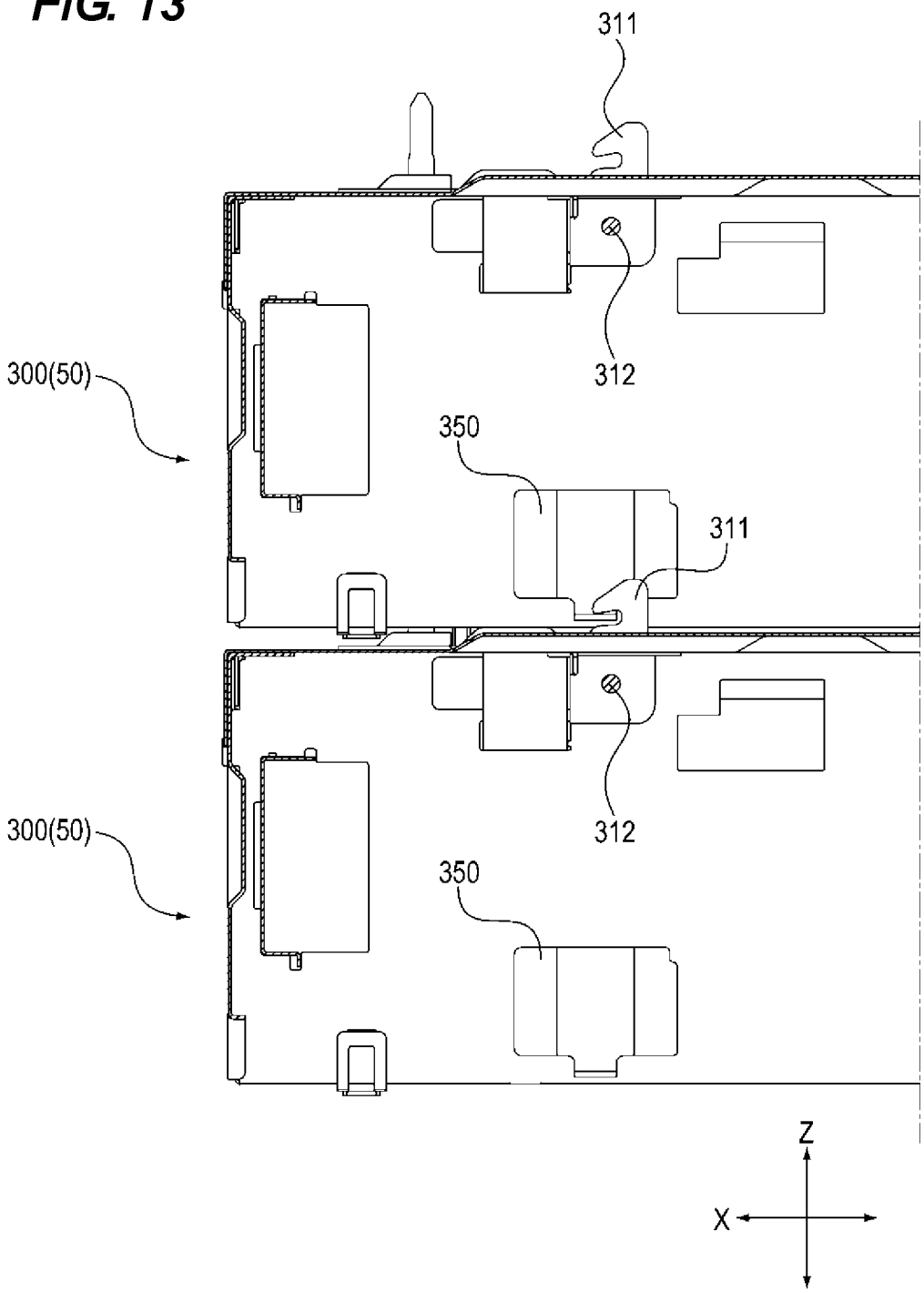
FIG. 13 is a cross-sectional view when two sheet feeding apparatuses are connected.

As shown in FIGS. 12 and 13, the rear hook 311 of the lower sheet feeding device 50 is engaged with the locking plate 350 of the upper sheet feeding device 50. Further, the front hook 319 of the lower sheet feeding device 50 is engaged with a locking plate (not shown) disposed between the plate-like member 96 and the plate-like member 97 of the upper sheet feeding device 50. The plate-like member 96 and the plate-like member 97 are arranged so that their surfaces are parallel to each other (the thickness directions of the plate-like members 96 and 97 are the same).

As a result, when the heating unit 100 is attached to the lower sheet feeding apparatus 50, it is possible to suppress the relative displacement between the upper feeding apparatus 50 and the lower feeding apparatus 50. In addition, by nipping the front hook 319 with the plate-like member 96 and the plate-like member 97, the front hook 319 can be prevented from being tilted in the front-rear direction.

In the present embodiment, the configuration has been described in which the attaching of the heating unit 100 is restricted by the rear hook 311 in the state where the locking of the frame body 300 to the frame body 80 of the main body 1 is released. However, the present invention is not limited to this. For example, the attaching of the heating unit 100 may be restricted by the front hook 319 with the front hook 319 rotating in a direction opposite to that of the present embodiment. With this configuration, similar effects can be obtained. Further, instead of restricting the attaching of the heating unit 100 directly by the front hook 319 or the rear hook 311, the movement of the heating unit 100 toward the attaching position may be restricted by another member that moves, interlocking with the rotation of the front hook 319 or the rear hook 311.

In the present embodiment, the configuration in which the frame body 300 of the sheet feeding apparatus 50 is locked to the frame body 80 of the main body 1 of the image forming apparatus A by the locking mechanism 310 has been described. However, the present invention is not limited to this. The frame body 300 of the sheet feeding device 50 may be locked to an attachment member or the like which is attached to the bottom surface of the image forming apparatus A.

In the present embodiment, the configuration of the locking mechanism 310 has been described in which the locking and the releasing of the locking mechanism 310 are performed by rotating the front hook 319 and the rear hook 311. However, the present invention is not limited to this. Namely, for example, by operating the operation unit 313, a member of the locking mechanism 310 may protrude toward the bottom surface of the image forming apparatus A to fit into a recessed portion provided on the bottom surface of the image forming apparatus A, thereby locking the sheet feeding apparatus 50 to the main body 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-006143, filed Jan. 17, 2019, which is hereby incorporated by reference herein in its entirety.

What is claimed is:

1. A sheet feeding apparatus configured to be detachably attached to a lower part of an image forming apparatus with respect to a vertical direction and to feed a sheet to the image forming apparatus, the sheet feeding apparatus comprising:

a frame body;

a sheet cassette in which a sheet is stacked, the sheet cassette being accommodated in the frame body;

a heating unit configured to heat the sheet stacked in the sheet cassette, the heating unit being attachable to the frame body at a position above the sheet cassette with respect to the vertical direction; and a locking member provided on an upper part of the frame body, the locking member being configured to be movable between a locking position where the frame body is locked to the image forming apparatus so that the frame body is not displaceable against the image forming apparatus and a releasing position where locking of the frame body is released so that the frame body is displaceable against the image forming apparatus, wherein, in a process of attaching the heating unit to an attaching position of the frame body, the locking member is configured to restrict a movement of the heating unit to the attaching position by interfering with the heating unit when the locking member is located at the releasing position and to allow a movement of the heating unit to the attaching position when the locking member is located at the locking position.

2. The sheet feeding apparatus according to claim 1, wherein the locking member is configured to be rotatable between the locking position and the releasing position when the heating unit is attached to the attaching position.

3. The sheet feeding apparatus according to claim 1, wherein the locking member is pivotally supported by a rotational shaft and rotates between the locking position and the releasing position.

4. The sheet feeding apparatus according to claim 3, wherein the rotational shaft is configured to guide a movement of the heating unit to the attaching position.

5. The sheet feeding apparatus according to claim 1, further comprising another locking member disposed upstream of the locking member in a direction of attaching the heating unit, the another locking member being configured to be movable between another locking position where the frame body is locked to the image forming apparatus and another releasing position where the locking of the frame body to the image forming apparatus is released.

6. The sheet feeding apparatus according to claim 5, further comprising a connecting member configured to connect the locking member with the another locking member, wherein interlocking with a movement of the connecting member, the locking member moves between the locking position and the releasing position while the another locking member moves between the another locking position and the another releasing position.

7. The sheet feeding apparatus according to claim 1, wherein the heating unit includes a protruding portion protruding in a direction of attaching the heating unit to the frame body, wherein the frame body includes a hole portion into which the protruding portion fits, and wherein the heating unit is positioned to the attaching position by the protruding portion fitting into the hole portion.

8. The sheet feeding apparatus according to claim 7, further comprising a first connector, wherein the heating unit includes a second connector through which electric power can be supplied when the second connector is connected to the first connector, and wherein the attaching position is the position where the first connector and the second connector can be connected to each other.

9. An image forming apparatus having a main frame body having an image forming portion configured to form an image, the image forming apparatus comprising:

a sheet feeding apparatus configured to be detachably attached to a lower part of the main frame body with respect to a vertical direction and to feed a sheet, the sheet feeding apparatus including:

a frame body;

a sheet cassette in which a sheet is stacked, the sheet cassette being accommodated in the frame body;

a heating unit configured to heat the sheet stacked in the sheet cassette, the heating unit being attachable to the frame body at a position above the sheet cassette in the vertical direction; and a locking member provided on an upper part of the frame body, the locking member being configured to be movable between a locking position where the frame body is locked to the main frame body so that the frame body is not displaceable against the main frame body and a releasing position where locking of the frame body is released so that the frame body is displaceable against the main frame body, wherein, in a process of attaching the heating unit to an attaching position of the frame body, the locking member is configured to restrict a movement of the heating unit to the attaching position by interfering with the heating unit when the locking member is located at the releasing position and to allow a movement of the heating unit to the attaching position when the locking member is located at the locking position.

10. A sheet feeding apparatus configured to be detachably attached under an optional sheet feeding apparatus that is attached to a lower part of an image forming apparatus with respect to a vertical direction and to feed a sheet to the image forming apparatus, the sheet feeding apparatus comprising:

a frame body;

a sheet cassette in which a sheet is stacked, the sheet cassette being accommodated in the frame body;

a heating unit that is attachable to the frame body at a position above the sheet cassette in the vertical direction; and a locking member provided on an upper part of the frame body, the locking member being configured to be movable between a locking position where the frame body is locked to the optional sheet feeding apparatus so that the frame body is not displaceable against the optional sheet feeding apparatus and a releasing position where locking of the frame body is released so that the frame body is displaceable against the optional sheet feeding apparatus, wherein in a process of attaching the heating unit to an attaching position of the frame body, the locking member is configured to restrict a movement of the heating unit to the attaching position when the locking member is located at the releasing position and to allow a movement of the heating unit to the attaching position when the locking member is located at the locking position.

11. The sheet feeding apparatus according to claim 10, wherein the locking member is configured to be rotatable between the locking position and the releasing position when the heating unit is attached to the attaching position.

12. The sheet feeding apparatus according to claim 10, wherein the locking member is pivotally supported by a rotational shaft and rotates between the locking position and the releasing position.

13. The sheet feeding apparatus according to claim 12, wherein the rotational shaft is configured to guide a movement of the heating unit to the attaching position.

14. The sheet feeding apparatus according to claim 10, further comprising another locking member disposed upstream of the locking member in a direction of attaching the heating unit, the another locking member being configured to be movable between another locking position where the frame body is locked to the optional sheet feeding apparatus and another releasing position where the locking of the frame body to the optional sheet feeding apparatus is released.

15. The sheet feeding apparatus according to claim 14, further comprising a connecting member configured to connect the locking member with the another locking member, wherein interlocking with a movement of the connecting member, the locking member moves between the locking position and the releasing position while the another locking member moves between the another locking position and the another releasing position.

16. The sheet feeding apparatus according to claim 10, wherein the heating unit includes a protruding portion protruding in a direction of attaching the heating unit to the frame body, wherein the frame body includes a hole portion into which the protruding portion fits, and wherein the heating unit is positioned to the attaching position by the protruding portion fitting into the hole portion.

* * * * *